US010900253B2

(12) United States Patent
Hubener

(10) Patent No.: US 10,900,253 B2
(45) Date of Patent: Jan. 26, 2021

(54) FENCE POST DRIVING APPARATUS

(71) Applicant: Carl H. Hubener, Topeka, KS (US)

(72) Inventor: Carl H. Hubener, Topeka, KS (US)

( * ) Notice: Subject to any disclaimer, the term of this patent is extended or adjusted under 35 U.S.C. 154(b) by 0 days.

(21) Appl. No.: 16/432,133

(22) Filed: Jun. 5, 2019

(65) Prior Publication Data

US 2019/0284836 A1 Sep. 19, 2019

Related U.S. Application Data

(62) Division of application No. 14/997,500, filed on Jan. 16, 2016.

(51) Int. Cl.

| | |
|---|---|
| ***E02D 7/16*** | (2006.01) |
| ***E04H 17/26*** | (2006.01) |
| ***B25F 5/00*** | (2006.01) |
| ***E02D 7/10*** | (2006.01) |
| ***E21B 7/02*** | (2006.01) |
| *E02D 7/06* | (2006.01) |

(52) U.S. Cl.

CPC ..... *E04H 17/263* (2013.01); *B25F 5/005* (2013.01); *E02D 7/10* (2013.01); *E02D 7/16* (2013.01); *E21B 7/028* (2013.01); *E02D 7/06* (2013.01)

(58) Field of Classification Search

CPC ... E04H 17/261; E04H 17/263; E04H 17/265; E02D 7/02; E02D 7/04; E02D 7/06; E02D 7/10; E02D 7/125; E02D 9/02; E02D 13/02; E02D 13/04; E02D 13/10; E02D 7/16; B25B 27/026; A01G 17/16; A01G 23/06; A01G 23/065

USPC .. 173/27, 28, 53, 55, 90, 189, 42, 184, 132, 173/124, 31, 32, 37; 254/29 R, 30, 131, 254/132, 199; 405/232; 294/104

See application file for complete search history.

(56) References Cited

U.S. PATENT DOCUMENTS

| | | | | | |
|---|---|---|---|---|---|
| 1,724,814 | A * | 8/1929 | Wolcott | E21B 1/00 | 173/55 |
| 2,310,960 | A * | 2/1943 | Johansen | E21B 3/04 | 279/109 |
| 2,378,131 | A * | 6/1945 | Dirksen | E04H 17/263 | 173/53 |
| 2,593,186 | A * | 4/1952 | Richardson | E04H 17/263 | 173/53 |
| 2,844,006 | A * | 7/1958 | Lutz | E04H 17/263 | 173/124 |
| 2,882,690 | A * | 4/1959 | Frederick | E02D 7/125 | 173/124 |
| 2,888,245 | A | 5/1959 | Anderson | | |
| 3,019,608 | A * | 2/1962 | Marmion | E02D 13/10 | 405/232 |
| 3,709,464 | A * | 1/1973 | Johnson | H01R 4/66 | 254/29 R |
| 4,002,210 | A * | 1/1977 | White | E02D 7/08 | 173/26 |
| 4,028,901 | A * | 6/1977 | Barber | E02D 13/02 | 405/277 |

(Continued)

*Primary Examiner* — Scott A Smith

(74) *Attorney, Agent, or Firm* — Bruce J. Clark

(57) ABSTRACT

A non-impact fence post driver attachable to a front end loader or similar mobile machine for operation has a hydraulic driven sleeve assembly suspended from a U-joint so as to vertically self-align from the loader, and has a fence post holding shell assembly attached to the sleeve with retractable gate hinged locking assembly to hold the fence post securely near the bottom while driving the post.

8 Claims, 15 Drawing Sheets

(56) References Cited

U.S. PATENT DOCUMENTS

| | | | | | |
|---|---|---|---|---|---|
| 4,083,192 | A * | 4/1978 | Diekman | E02D 13/04 | 405/281 |
| 4,124,081 | A * | 11/1978 | Deike | E02D 7/10 | 173/147 |
| 4,280,772 | A | 7/1981 | Rusche | | |
| 4,665,994 | A * | 5/1987 | Snider | E02D 7/04 | 173/128 |
| 4,915,180 | A | 4/1990 | Schlisler | | |
| 5,010,710 | A * | 4/1991 | Gray | E04H 17/263 | 173/90 |
| 5,167,288 | A | 12/1992 | McNeil | | |
| 5,304,015 | A * | 4/1994 | Sonomura | E02D 7/06 | 405/232 |
| 5,392,866 | A | 1/1995 | White | | |
| 5,494,117 | A | 2/1996 | Aldridge | | |
| 5,558,169 | A | 9/1996 | Madgwick | | |
| 5,868,211 | A | 2/1999 | Bohn | | |
| 6,182,772 | B1 * | 2/2001 | Lagasse | E04H 17/263 | 173/1 |
| 6,591,919 | B1 | 7/2003 | Herrmann | | |
| 6,889,777 | B2 | 5/2005 | Boley | | |
| 7,597,156 | B1 | 10/2009 | Reid | | |
| 7,950,470 | B2 | 5/2011 | Reid | | |
| 9,797,159 | B2 * | 10/2017 | Breeden, III | E04H 17/263 | |
| 2006/0113444 | A1 * | 6/2006 | Parsons | E04H 17/263 | 248/274.1 |

* cited by examiner

FENCE POST DRIVING APPARATUS

This application is a divisional application of application Ser. No. 14/997,500 filed Jan. 16, 2016 and claims the benefit of its filing date of Jan. 16, 2016 pursuant to 35 USC Sect 120, 121.

BACKGROUND OF THE INVENTION

This invention relates to the field of nonimpact fence post driving apparatus, including T-post driving apparatus for attachment to commonly available hydraulic machines such as loaders, tractors, and the like.

Fence post drivers are not new. The most basic are hand devices that slip over the top of the T-post and allow slidable movement to pound the post into the ground by repeated raising and lowering of the device so as to drive it. More advanced apparatus use power means with mechanical arrangements that allow repeated pounding, or impacting. Impact apparatus have a number of disadvantages, including but not limited to high noise, as well as less accuracy in vertical alignment and depth.

Continuous motion fence post drivers allow for continuous inserting, not by the incremental steps as done by impact apparatus. In this manner, continuous driving apparatus are not only quieter, but allow for accurate monitoring of depth of the post, as well as more accurate vertical alignment. Other features of the continuous driving apparatus will be seen herein in describing the invention.

The invention is a non-impact T-post driver that is removably attachable to a front end loader, tractor, or other similar mobile equipment having hydraulic capability and having a bucket or other arm extending device from which to attach or 'hang' the apparatus while utilizing the hydraulics of the front end loader. It does so with advantages that include in the preferred mode, among other things, the ability to plant the post from the side of the loader. In this mode, it can hang offset to the side of the equipment, thus allowing the equipment to drive in a straight line parallel to the side of the fence line thus allowing the tractor to continue to drive forward in line with the intended fence continuously placing posts when and where desired. Existing drivers provide for front end placement, requiring the operator to move up and back for each post, often perpendicularly positioned to the fence line under construction, taking more time. In one mode of the invention, a basket is included that will hold a supply of posts in a position most readily available for continuous, rapid and repeated post driving.

The invention hangs from the arm of the tractor using a U-joint, thus allowing gravity to align it, and thus the fence post it is holding, to be true vertical.

It also does so without bending or tending to bend the posts by providing the drive means at the lower end of the post, transferring the drive force from the hydraulic cylinder to the post at the lower end. Thus, as opposed to impact or other drivers that drive the post at the top, the instant invention drives at the bottom, avoiding the bending momentum forces that otherwise exist.

The invention has a unique designed quick release Operating handle that drives the gates that grab the post at high and low ends, securing the post flatly and uniformly for proper orientation, and with a small drive lug that quickly fits between the post nubs, or teeth, to secure the post vertically upon closing of the handle, all as will be seen. The invention thus allows for simple and quick insertion of the post into the apparatus to allow the apparatus to firmly grab the post sufficient in accordance with the significant hydraulic pressure that is necessary for continuous movement of the post into the ground, and to do so accurately. It also allows for quick release once complete. It also allows for safety features for safe operation given the nature of the heavy equipment being used and the nature of the task involved, including quick releases and pressure releases.

T posts have as a feature a face, and have wire grabbing teeth or nubs on one side. Thus it is necessary to uniformly set each post oriented the same with the nubs facing the same direction, and the invention accomplishes that at the same time.

The invention has guides for determining the proper depth, and has in one mode a measuring wheel mounted to the support equipment that rotates in response to the movement of the equipment, and acts in association with a buzzer or other audible sound for the driver to know when to stop for the next post placement. The operator can also use a GPS locator if sufficiently accurate.

In the preferred modes, it is relatively easy to set as many as six posts per minute from a fully stocked bucket of posts.

It is thus an object of the invention to provide a continuous motion post driver, as opposed to an impact driver that is simple and efficient, capable of setting the post accurately in a straight line, with each post face true to the fence wire.

It is a further object of the invention to provide a fence post driver that does not bend or tend to bend the posts during insertion.

It is a further object of the invention to provide a post driver apparatus that is continuous and attachable to common available farm, excavation or work mobile machinery having hydraulic systems to which the apparatus can engage.

It is further an object to provide such an apparatus that allows for placing a plurality of posts using the mobile machinery in a continuous manner, by moving forward in a continuous line, post after post.

It is further an object to provide a continuous motion post driver apparatus that allows for simple and quick means to insert the post into the device, and is otherwise simple and quick to use.

It is further an object of the invention to provide a continuous post driver apparatus that allows for highly accurate placement, and highly accurate vertical depth and position, and do so in a manner that is quick, to allow high numbers of posts to be driven per given time period.

It is a further object of the invention to provide a continuous post driver apparatus with safety features to allow safe use on the farm or commercially.

It is a further object of the invention to provide a continuous post driver apparatus that minimizes moving parts and is thus more reliable and highly durable with less likelihood of breakdown.

Other features and objects will be apparent from the disclosure herein.

SUMMARY OF THE INVENTION

The invention is a non-impact continuous force fence post driver attachable to a front end loader or similar mobile machine for operation. In the preferred mode it utilizes the hydraulics of the front end loader and has a hydraulic driven sleeve assembly suspended from a U-joint so as to vertically self-align from an extension support member attached to the front end loader. A fence post holding shell assembly attached to the sleeve has retractable hinge locking assembly to hold the fence post securely near the bottom while driving the post.

DESCRIPTION OF THE PREFERRED EMBODIMENTS

Figure 1:
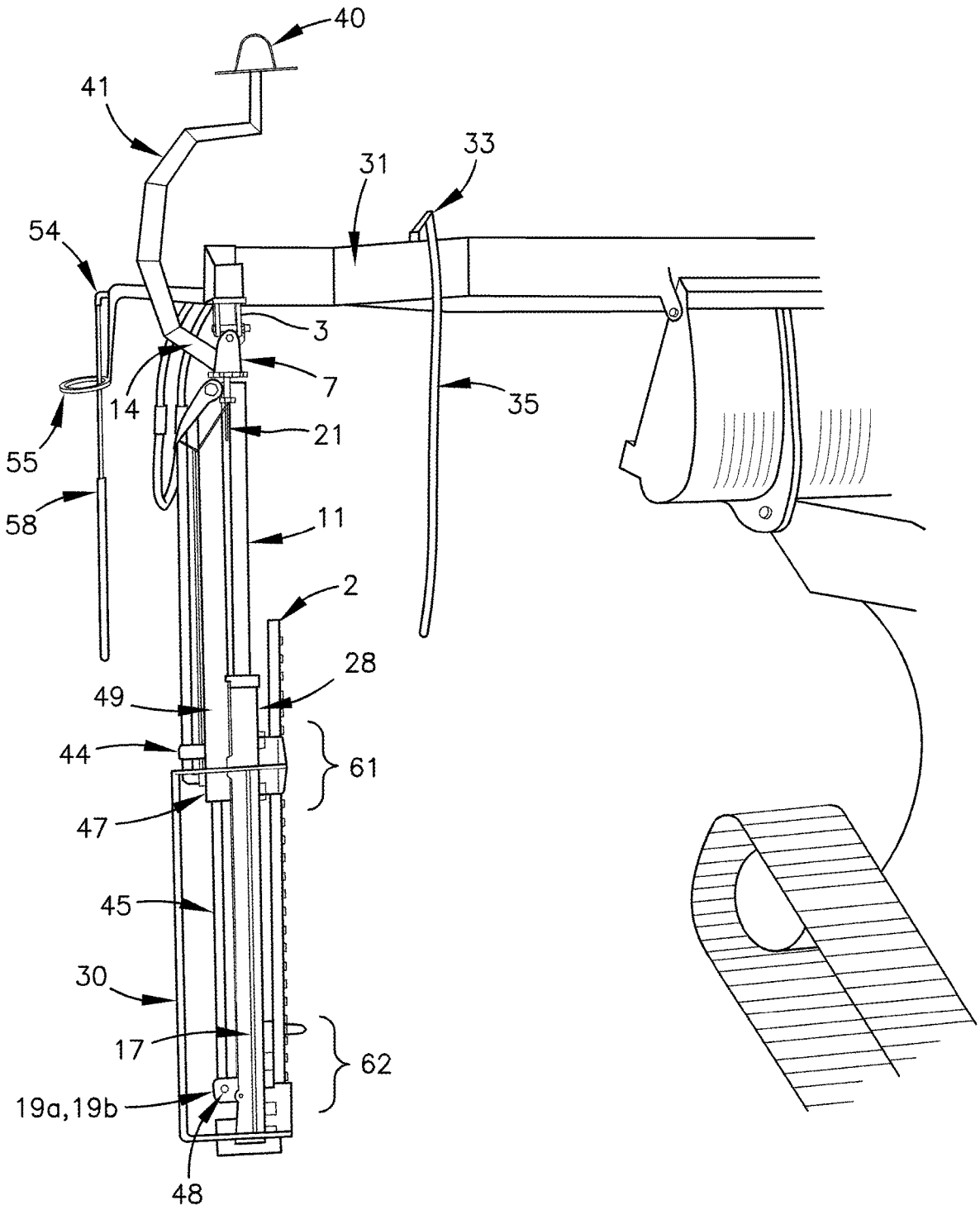
FIG. 1 is an overall perspective of the invention.

The invention is shown in FIG. 1 in the preferred mode attached to a loader bucket, although it can be suspended from any excavation machinery with hydraulic or other connectible power means for powering an attachment means. It is also any suspension means including a mobile machinery or standalone frame with means for suspending an attachment and having a connectible power source or access to a connectible power source (such as hydraulic power source) to power the attachment. For purposes of this disclosure, 'loader' will refer to all of the foregoing, as will the term "suspension means". In the preferred mode disclosed herein, the suspension means is a loader with bucket attachment having attachment means for other attachments to attach to the bucket. Power means refers in the preferred mode to the connectible hydraulic system of the loader that can drive an attachment, where the necessary auxiliary hydraulic lines can be accessed and connected to with minor adjustments.

While some buckets are known to be used to themselves force a post downward from the top, this invention has the bucket remaining at an essentially fixed point to allow the objectives of driving the post in a truer vertical motion and from the lower end of the fence post rather than the top, so there are no bending forces applied to the post.

It has several principal portions described that in the preferred mode suspends from offset beam 31 via a universal joint 3. Fence post securing means that releasably secure the fence post during driving are shown suspended from the beam using the universal joint to achieve a natural self alignment via gravitational force on the suspended attachment. The hydraulic drive assembly has ram means 45 driven by cylinder 49 in response to the hydraulic pressure, attached to drive sleeve 17 via drive sleeve lug 19. Shell assembly 28 is attached to the drive sleeve 17. Shell assembly is shown as removable, and has shell 29 that encompasses the sleeve 17 as will be discussed. The sleeve has slide tube 11 slideably attached therein so as to allow the sleeve, and thus entire shell assembly with post secured thereto, to slide up and down the slide tube as the hydraulic ram 45 moves up and down in accordance with the hydraulic force on the ram. Fence post securing means, shown here having upper securing means 61 and lower securing means 62, are fixed to the shell assembly 28. In this mode, the post is secured at upper post locking assembly 61 and at lower locking assembly 62, which are operated in conjunction utilizing retractable and hingeably connected operating handle 30 connected to both. These each will be discussed in more detail.

The drive stick 58 is attached to the hydraulic system via U-joint 54, and has its free motion limited by retaining lop 55. The drive stick provides the control for driving the hydraulic ram up and down. Pressure is released at the desired time via float valve control 33, with extension 35.

Removable GPS rigid antenna arm mount 14 allows for GPS attachment arm 41 (to which is attached the GPS antenna 40) although such mount means could be placed in other places in other ways. GPS antenna means 40 allows precise location of the post and more precision in line, and for legal boundary compliance as needed, or other desired location criteria. Consequently, the placement of the GPS positioning device should be placed in a known point in relation to where the fence post is being driven, if it is not placed directly above the fence post.

Figure 2:
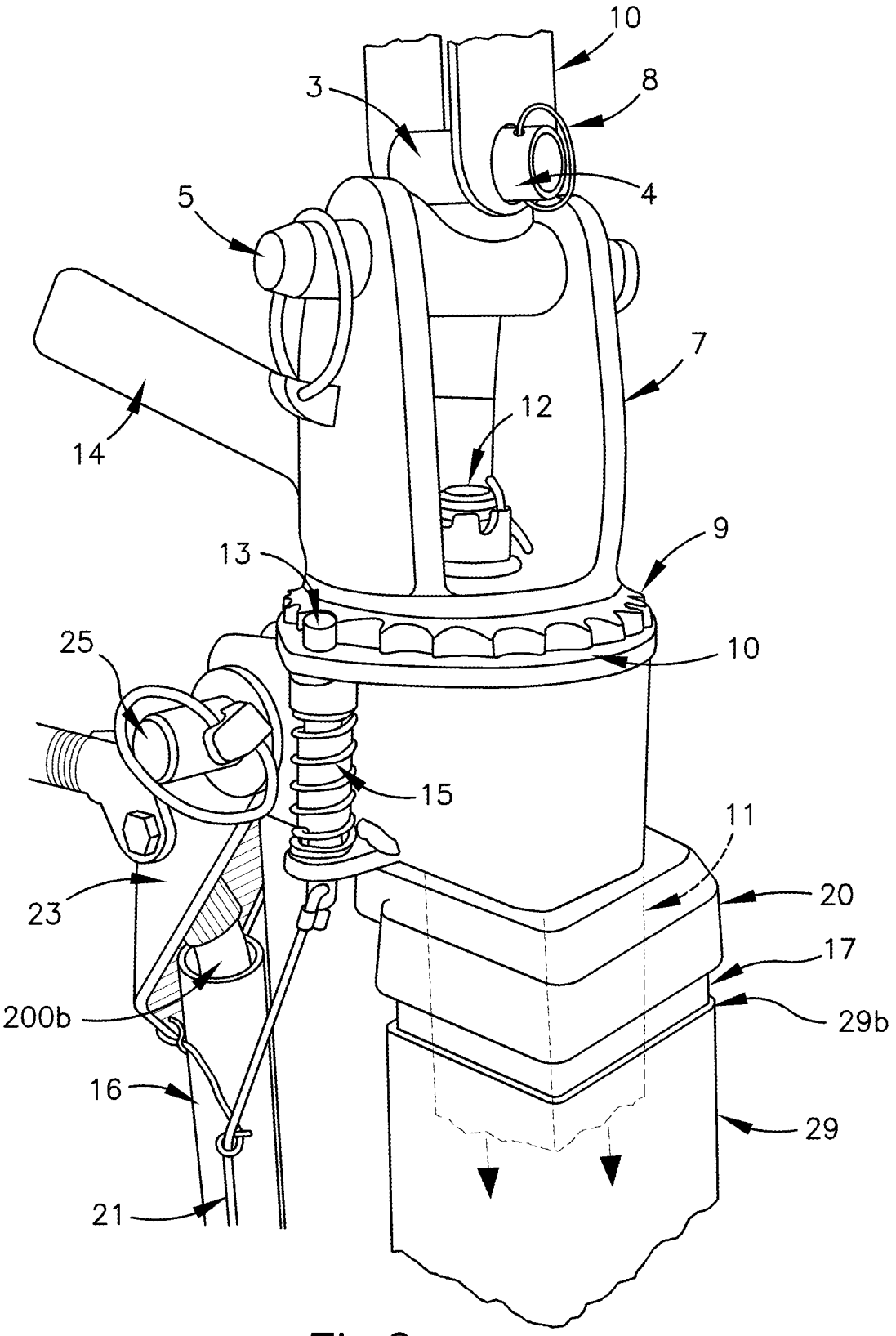
FIG. 2 is a view upper portion of the invention, including the U-joint and rotation yoke

FIG. 2 shows the suspension U-joint 3 attached to offset beam 31 via extension 10 having center rigid pin means 4 to allow rotational movement about one direction, and center transvers rigid pin means 5 to allow movement in a transverse direction 90 degrees rotated. Pin locking means 8 allows removal of the entire assembly when not in use or for maintenance.

The entire unit is thus suspended so as to allow it to 'self-align' vertically, plumb to the ground. This allows the device to be vertical and allows more importantly the post driving means to be and remain essentially vertical during the entire drive process. Thus, there is a fixed vertical point during the driving process where it is suspended and the bucket to which it is attached doesn't move. If the bucket were to provide the downward force, as some prior art suggests, a downward arc is created as the point of connection moves with the bucket, thus the post is not driven truly vertical into the ground. In this invention there is no moving point with relation to the bucket.

The entire device may be rotated to adjust the position of the fence post as needed to allow the fence post teeth to all face the desired direction. Rotation sector/yoke 7 is rotatably connected to pin 12, and locked in place using rotation selector pin 13 interconnecting with rigid teeth on rigid sprocket 9. Rotation selector 13 is a tension loaded pin, here shown as spring loaded with selector spring 15, which when pulled down with control handle 16 and spring loaded release cable 21, allows the rotation of the device. Thus the U-joint 3 has rigid rotation yoke with sprocket 9 having a face opposing the rigid planar face 10 of the device attached to slide tube 11, and allows for the rotation of the entire device in relation to adjacent sprocket 9 and hydraulic cylinder assembly 47 is removably attached via cylinder handle mount pin 25. Although only one pin 13 is shown, more pins are allowable. Additional pins placed in offsets (rather than in equidistant locations matching the sprocket teeth separation) allow for more precise rotational movements as desired. Drive sleeve 17 slides about slide tube 11 and has shell mount collar 20 to receive the top of the removable shell assembly 28.

Figure 3:
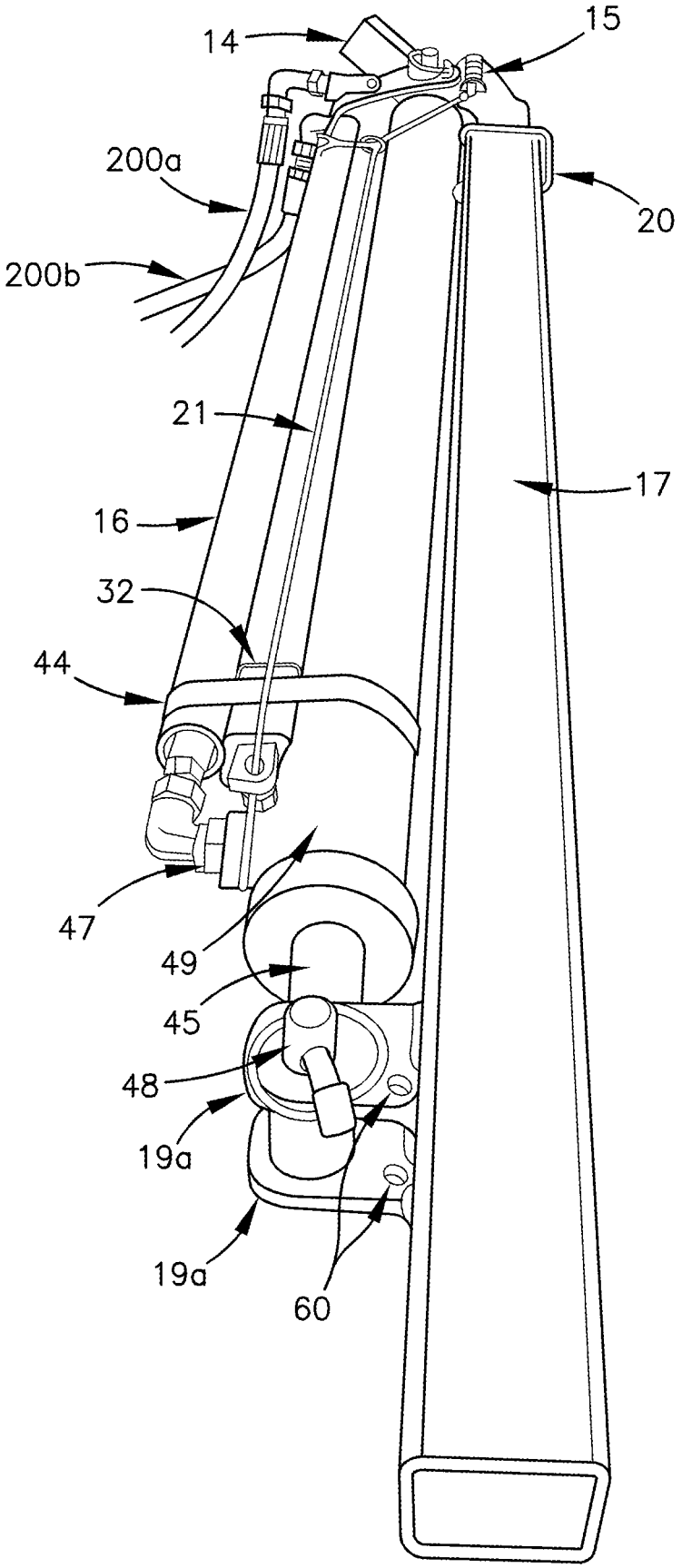
FIG. 3 is a view of the hydraulic assembly with the drive sleeve

FIG. 3 shows the drive sleeve assembly having a drive sleeve 17 in the up position, thus the slide tube 11 about which it slides is inside and not shown. The hydraulic cylinder provides the force for driving the drive sleeve 11 in an essentially vertical direction, although other force means such as pneumatic means are envisioned. The drive sleeve will receive the shell 29 shown in FIG. 4, which shell is removably attachable to the drive sleeve and held in place in two places in this mode, at the top of the drive sleeve where the top of the shell 29 slides under the shell mount collar 20, and at the bottom of the drive sleeve at holes 60 which align with holes in assembly lugs 51 in shell 29 in FIG. 4, through which removable pin 51*a* is inserted and secured. Hydraulic drive assembly 47 is shown with typical hydraulic cylinder 49 with cylinder ram 45 releasably connected to the drive sleeve 17 at drive sleeve lug mounts 19*a* and 19*b* via cylinder ram pin 48. Drive sleeve mounts are rigidly connected to the drive sleeve. Hydraulic hoses 200*a* and 200*b* feed the hydraulic fluid to and from the hydraulic cylinder 49. Control handle 16 is secured to the cylinder 49 with clamp 44 with rigid spacer 32 therebetween to comprise a hydraulic assembly 47. Shell pin holes correspond to shell assembly lugs to releasably secure the shell assembly 28. Rotation cable release 21 is shown attached so as to allow extended control of the rotation by the operator.

Figure 4:
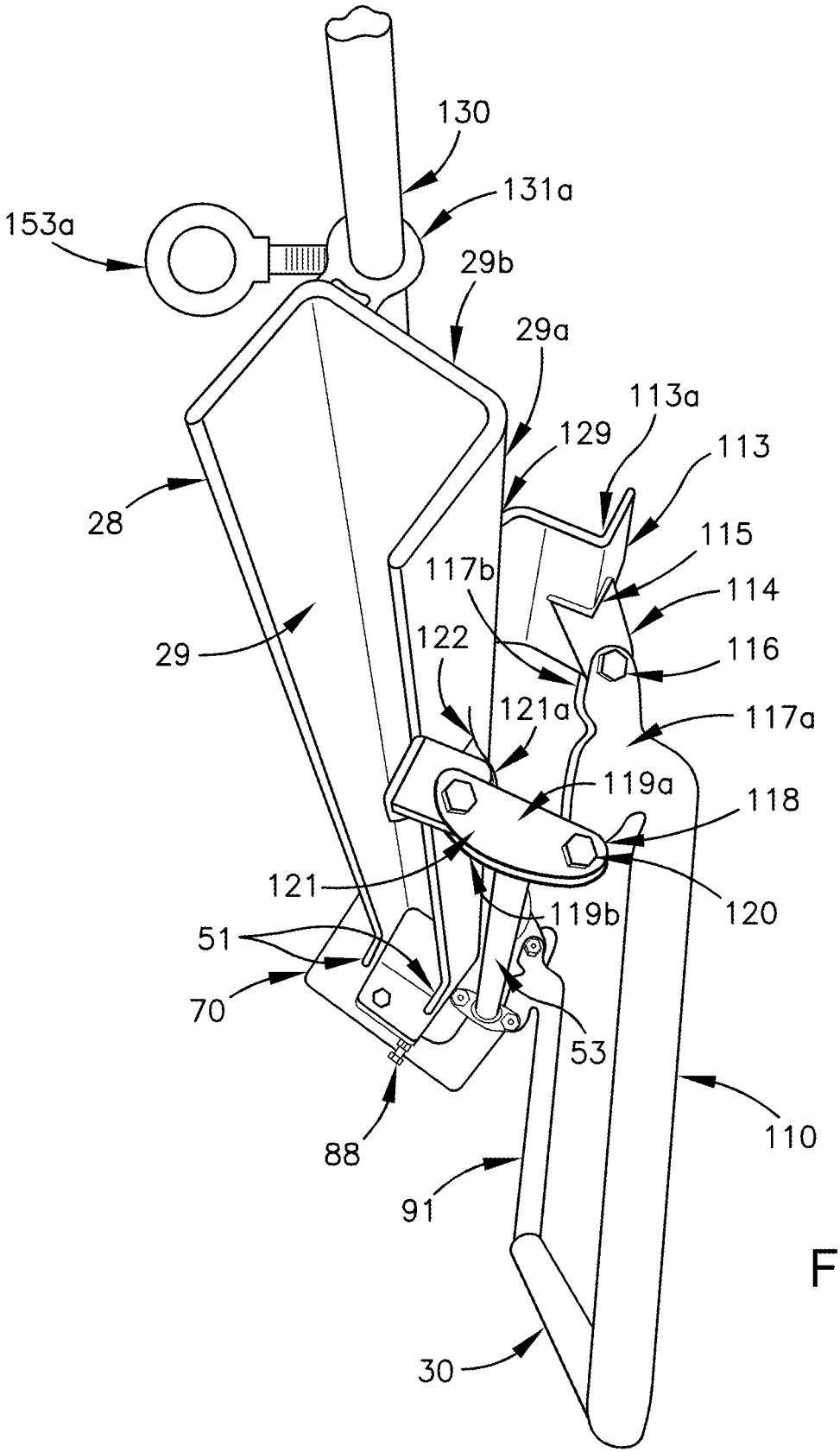
FIG. 4 is a view of the shell assembly from above

FIG. 4 shows the shell assembly 28, which is removably attached to the drive sleeve 17. An alternative shell assembly is shown elsewhere herein as essentially a 'reverse' shell, used where setting posts from the opposite side is desired or needed. Thus drive sleeve 17 accepts changeable shell assemblies.

It should be noted that the shell assembly, although removable, is not required to be removable for the invention. The shell assembly and/or its parts can be affixed directly to the drive sleeve.

In the preferred mode, the top 29*b* of the shell 29 fits relatively snugly in the shell mount collar 20 in FIG. 2 and FIG. 3, and the bottom is attached via mount lugs 51 shown in FIG. 4. Ground foot 70 is a planar rigid member that meets the ground when in use. Although shown as planar, it can be any means for sensing when the post has entered the ground at the required depth sufficient to stop further driving. It is also a visual means for where the post will be at ground level when inserting the post into the device. As a planar rigid member, it provides the means for stopping the downward movement of the hydraulic ram when it meets the ground in that it causes increased force and more pressure on the hydraulics so as to activate the release valve when the hydraulic pressure reaches a certain predetermined pressure, discussed more hereafter. Top stop bar 130 is part of the guide assembly with top stop safety means, and is slidably attached in shell ring 131*a* fixed to the shell 29 and is adjustable up and down via adjust eye bolt 153*a*. Post size adjustment screw 88 allows for different size posts.

The upper latch means 61 in FIG. 1 is shown in more detail here in FIG. 4. It has upper latch gate 113 that is hingedly connected to the shell 29 and driven by a series of rigid link members 114, 117 (comprised in the preferred mode of link pair 117*a* and 117*b*) and 119 (comprised of link pair 119*a* and 119*b*). In the preferred mode, link 114 at one end is sandwiched between one end of the link pair 117 at 116, and the other end of the link pair 117 is sandwiched between link pair 119*a* and 119*b* at 118. Link 122 is fixed to the shell 29. The links and handle 30 are connected as shown in the preferred mode so as to grip and secure the post when the handle 30 is brought into place, and actually lock the post into place in a self-locking (latching) manner. Upper latch gate 113 is shaped as shown, having a first approximately 90 degree bend in the preferred mode, although any bend is envisioned to function to hold the post. It has a second bend in the opposite direction, and is hingedly connected at 129 to the shell 29. Rigid upper drive latch 114 is connected to gate 113 to the first bend as shown so as to drive the gate as shown, although any means to drive the gate is envisioned. Upper drive link 117 is affixed to the upper handle 110 and has a first end with holes that correspondingly are hingedly connected at 116 to link 114 (which link 114 has a corresponding hole at its end opposite 115) and at a second opposing end 118 to intermediary links 119*a* and 119*b*. Link 119*b* is attached to synchronizing tube 53.

The other end of link pair 119 connects to link 122 at 121 via elongated slotted hole 121*a* in link 122 that works in conjunction with the lower locking mechanism to assist in providing the self-locking feature. The upper and lower linkage toggles over center and locks the post in place when properly adjusted to fit the selected post. This self-locking is achieved via the hinged (pivotal) connections at 116, 118, 121 in combination with the upper arm bar 110 being connected to the upper drive link pair 117. By driving link pair 117 forward against member 114, the gate 113 is hingedly rotated at 129 and secures the post (not shown, but held in place at the interior 113*a*) against the post mount bar 68 (FIG. 8) at the side of the shell 29 at 29*a*. Link pair 119 hinges and slides its furthest hinge connection 121 at the opposite end in the slotted hole 121*a*, and acting together brings the assembly into a locked position when the gate 113 is brought sufficiently forward past a toggle point. Moving the link pair 119 in the slot 121*a* changes the direction of force of link pair 119 so as to force the other links to remain in place. Self-locking here refers to means for holding the bar in place once the operator takes his hands off the handle 30, in this case without the operator even engaging a separate locking means, and is done here simply by moving the handle far enough such that the force of the links keeps the handle in the locked (latched) position. It is also commonly known as "toggle past center" latching, where once the locking mechanism reaches at or near a center point in motion, it tends to toggle back and stay in place. The apparatus for this toggle past center feature is new.

The links and related members that they are attached or linked to just described comprise the upper locking means 61. This similar self-locking means, as will be shown, occurs in the lower locking means 62 simultaneously via synchronizing tube 53 operating together with the handle 30, upper operating arm 110 and lower operating arm 91.

Figure 5:
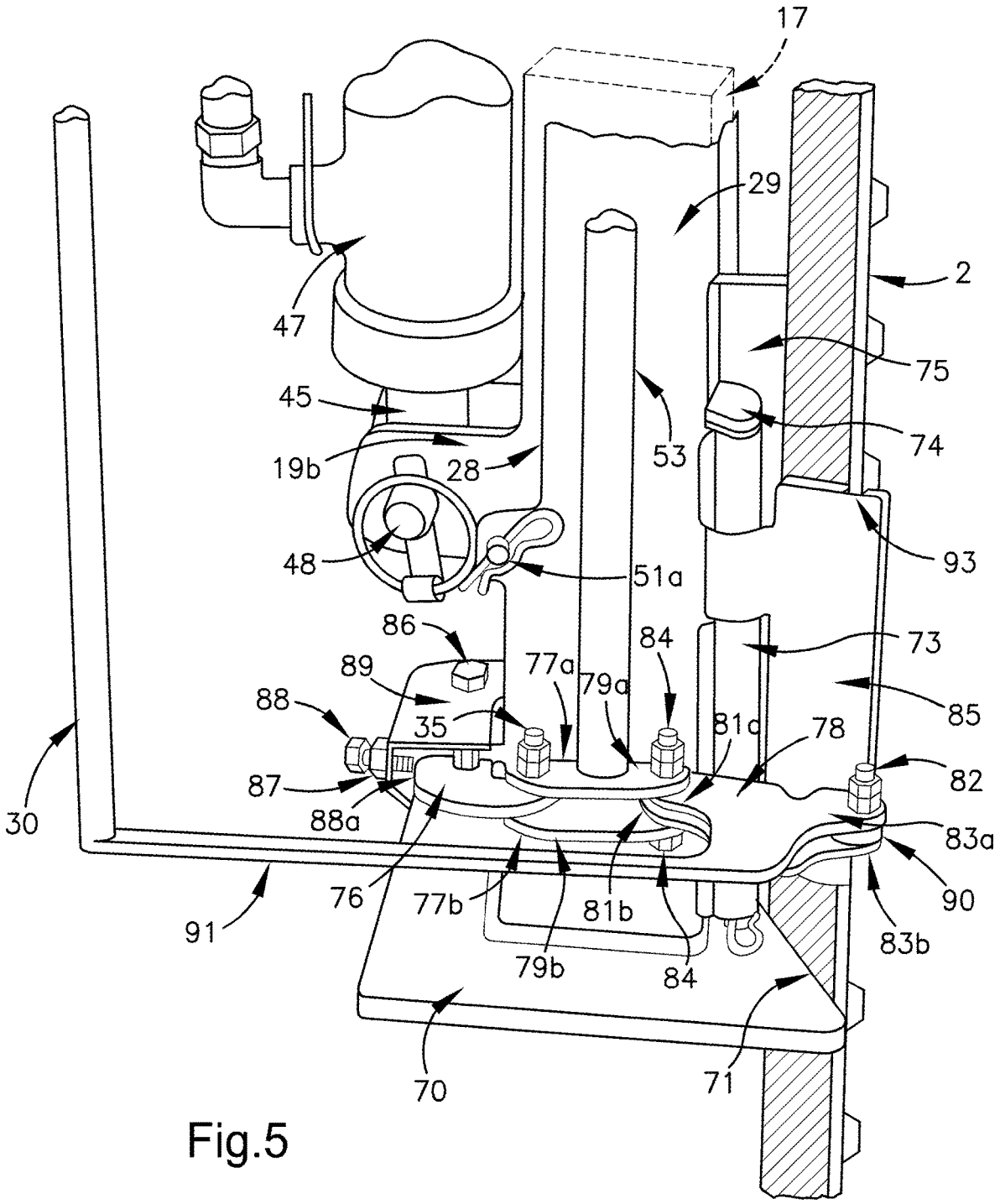
FIG. 5 is a view lower part of the device with a post latched in place FIG. **6*a* is a close up view of the device with the gate open at the lower section FIG. 6***b* is a close up view with post in place and latch gate closed

FIG. 5 shows this lower locking mechanism 62 and the lower portion of the shell assembly 28. The drive ram 45 attached to and driving the lower end of the shell 29 at 48 provides one key to this invention, i.e. driving the post near the bottom half of the post, in this case near the bottom.

The lower securing (locking) means 62 has a linkage of links similar in function to the upper securing means 61. Lower arm bar 91 has lower drive link 78 attached at a first end. Link 78 has at its first end an upper and lower portion, 83*a* and 83*b* respectively spaced apart and both hingedly connected with pin through holes at 82 to lower drive lug link 90 between them (which lug link is attached to lower latch gate 85) so as to allow the end 78 to drive the lower latch gate 85 against the post 2 via hinged connection 82. Lower latch gate 85 is hinged to the shell 29 via hinge means 73 and pin 74.

The opposing second end of lower drive link 78 similarly has upper portion and lower portion 81*a* and 81*b* respectively, spaced apart. That space, in this mode, allows for link 76 to move in between during gate opening. Upper portion 81*a* is hingedly connected at 84 to lower intermediary link 79*a* at its first end via holes and pin at 84. Link 79*a* is attached to the synchronizing tube 53 and thus moves in conjunction with its counterpart upper intermediary link 119*b* in FIG. 4 via said tube 53. Spaced apart from link 79*a* and corresponding thereto as shown, is link 79*b*, having holes at its respective first and second ends at 84 and 35 to allow a common pin to penetrate all holes at 84 such that link 79*a* and link 79*b*, at 84, hingedly (pivotally) connect to operate together in hinged relation to ends 81*a* and 81*b*.

The opposing ends 77*a* and 77*b* of intermediary link 79*a* and 79*b* is hingedly connected via pin 35, together, to shell lower lug link 76 there between, at the lug link's first end. In this mode, there is not needed, nor shown, a slotted hole in link 76 at 35. Link 76 is essentially, in this mode, an L shaped rigid member hingedly attached at its second end via pin 86 to bracket 89 that is attached to the shell 29. An adjustment bolt 88 screwing through the bracket 89 has its end touching the lug 76 such that rotation of the bolt 88 tightens or loosens at 88*a*, thus restricting the movement of said L shaped rigid member at that side, forcing or allowing lug 76 in or out, to allow more or less movement in lug 76. Bolt 88 is locked in place with locking nut 87. Thus the mechanism is allowed greater or lesser movement during self-latching which allows for means for adjusting for various post sizes to be latched or locked in by the upper and lower gates.

It should be noted that unless otherwise indicated, hinged connections also includes pivotal connections for purposes of this invention.

The post 2 is set and locked in place up against the lower post mount bar 75 that is attached to the shell 29. The edge of the post 2 fits in notch 93. Angle edge 71 of ground foot 70 allows for easier retraction of the device away from the driven post once the post is inserted and the latch is released.

Figure 6A:
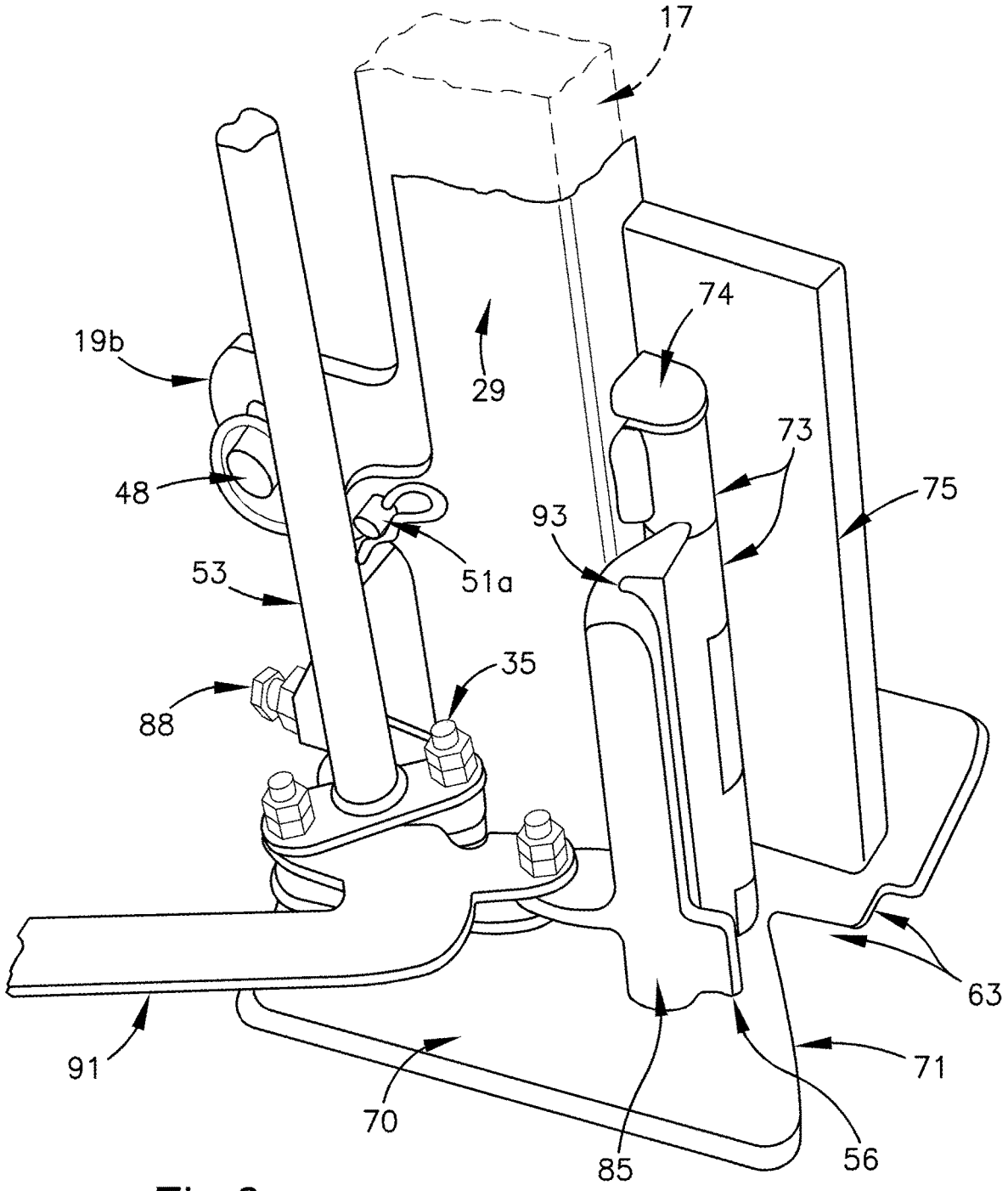

FIG. 6*a* shows a closer view of the bottom portion of the shell assembly in an open position. Post contour notches 63, in conjunction with notch 93, help secure the fence post when lower latch gate 85 is closed so as to allow the post to be secured firmly during driving, particularly at this lower area. Drive lug 56 from lower latch gate 85 fits between the post teeth to provide further stability in this regard. It is from this lower area that the post is driven by the hydraulic drive means, an object of the invention. By driving from the bottom half or below (of the post) no bending moment is created that would otherwise tend to bend the post while undergoing the significant forces present during driving of the post.

Figure 6B:
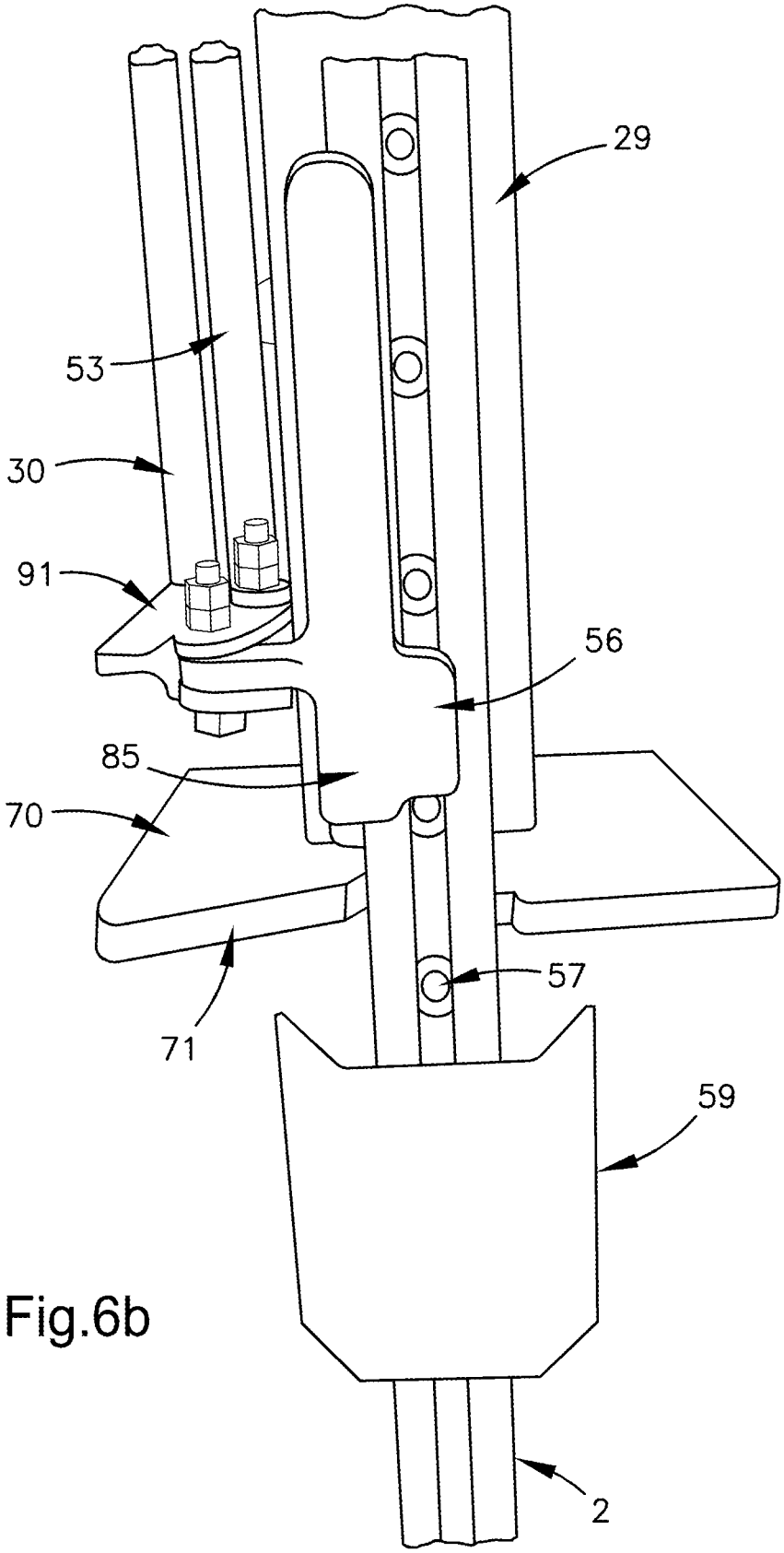

FIG. 6*b* is a close up similar to 6*a* but in the closed position. Fence post foot blade 59 can be seen as can the fence teeth 57. Gate 85 locks the post into place with drive lug extension 56 fitting between the post teeth.

Figure 7:
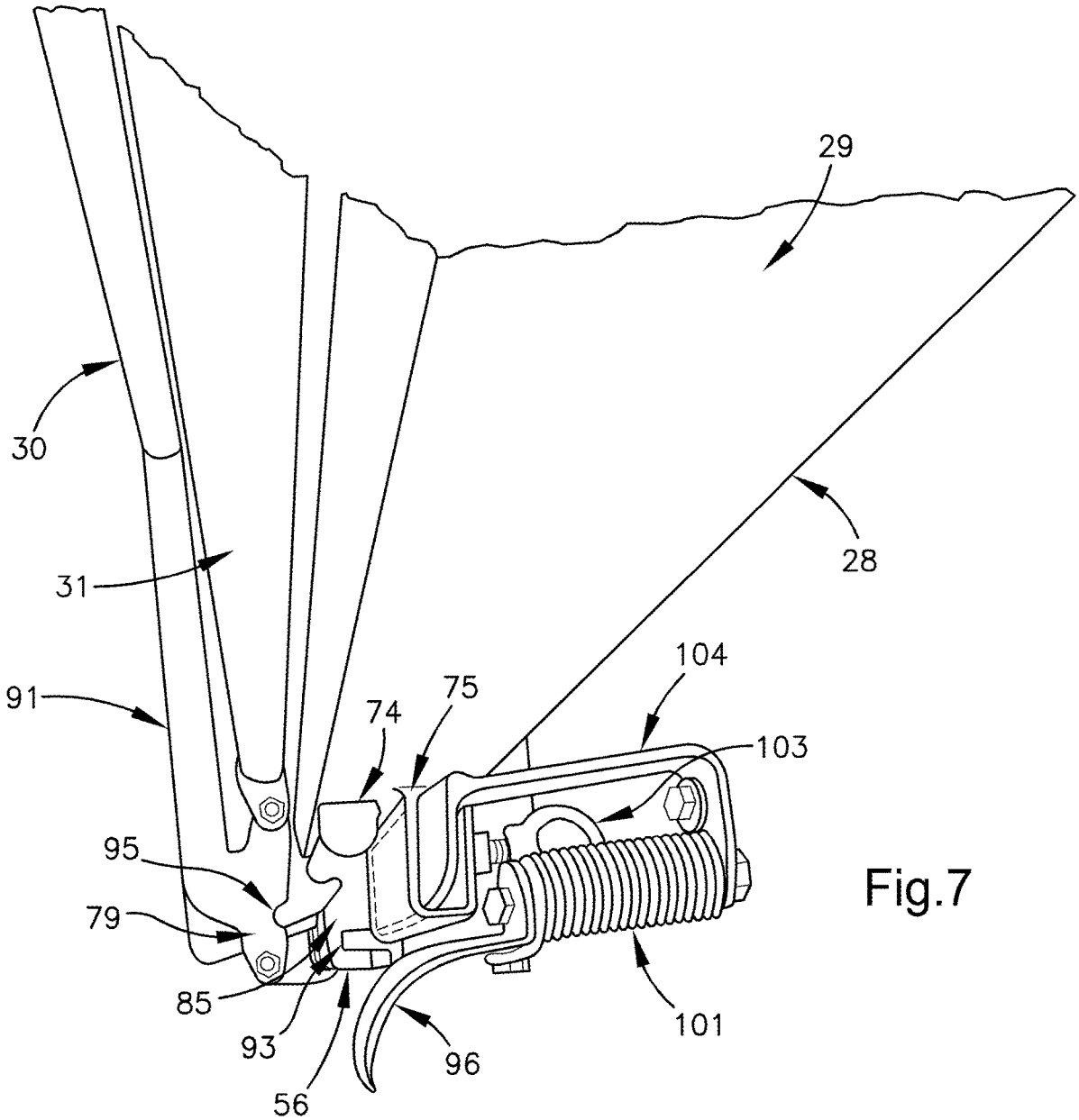
FIG. 7 is a close up view of the latching mechanism looking down

FIG. 7 shows the height guide looking down on it. Post guide mount bracket 104 slides within post mount bar 75. Post mount bar 75 has a hollow interior for that purpose. Eye bolt 103 extends to the interior of the post mount bar 75 to hold the bracket in the desired position so as to have the spring-loaded guide shoe 96 fit between the teeth at the desired location on the post 2. Height guide arm 104 has spring loaded (via spring 101). The lower latch gate is shown in the closed, latched, position, showing where fence post 2 would mount secured against the lower post mount bar 75 with notch 93 holding one edge of the fence post.

Figure 8:
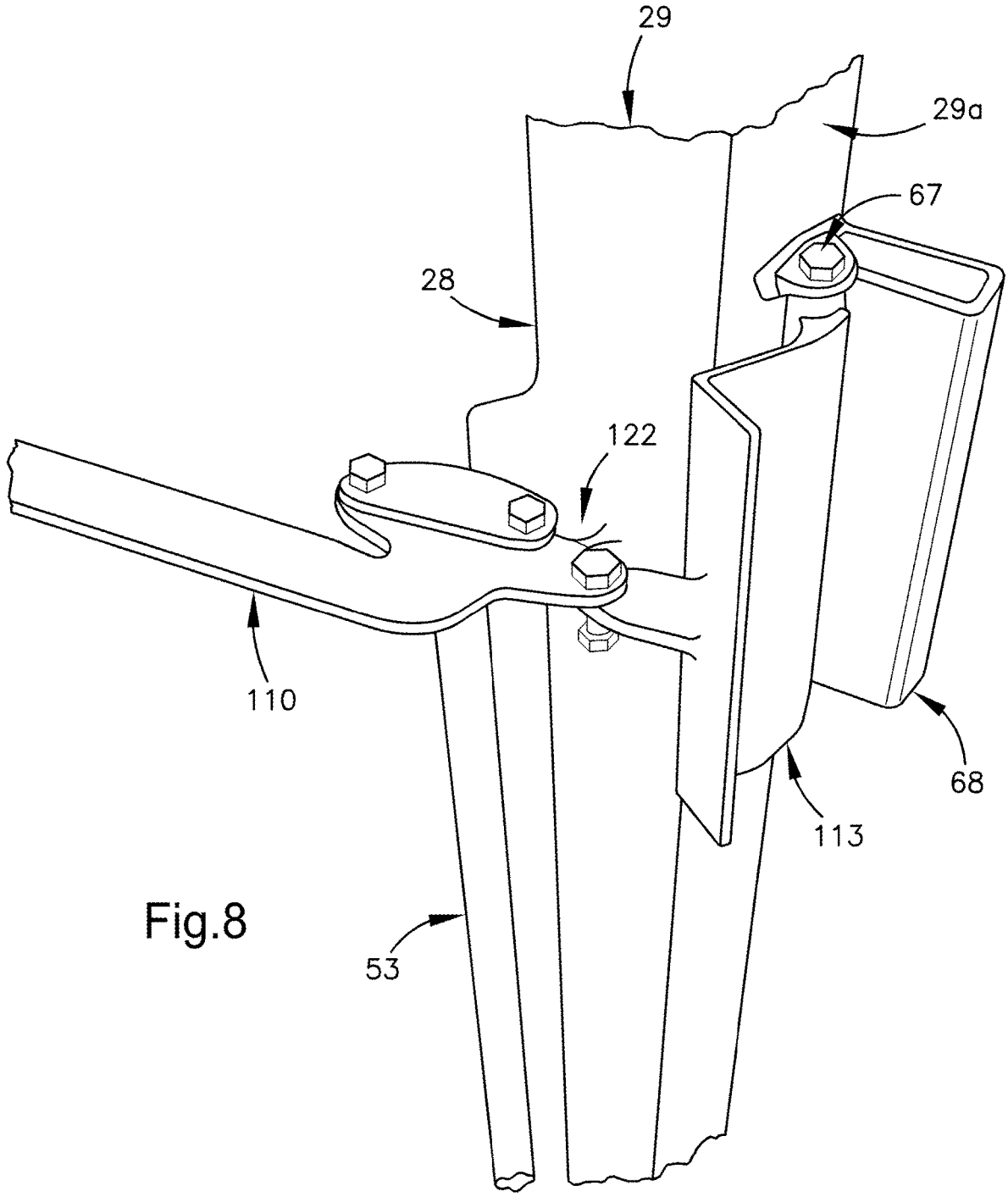
FIG. 8 is a close up view of the upper latch assembly

FIG. 8 is a close up view of the upper latch assembly 61. Upper latch gate 113 is shown open, but upon pulling the operating handle 30 (FIG. 5) forward in a condensed "C" motion, looking down from above in the preferred mode, according to the position of the operating handle 30 with respect to link pair 117 and lower link pair 78 (a motion that is typical with a toggle past center mechanism), the upper latch gate 113 closes and releasably locks and secures the post to upper post mount bar 68.

Figure 9:
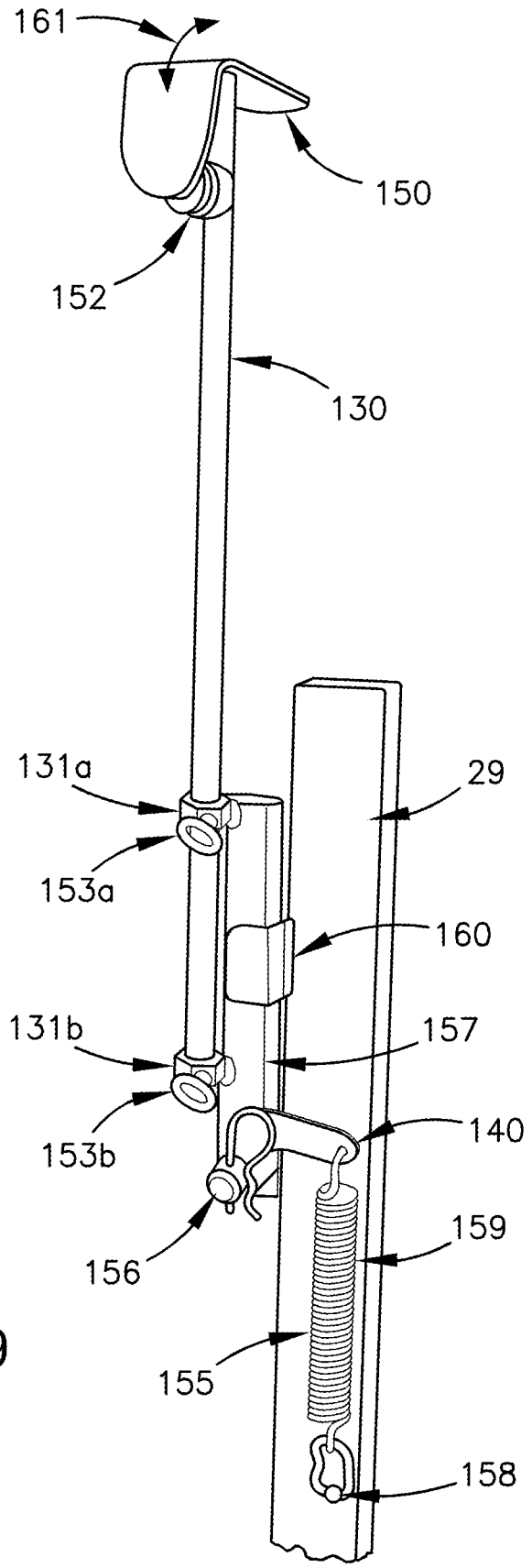
FIG. 9 is a close up view of the top stop assembly

FIG. 9 shows the height adjustment with top stop assembly. The top stop mount bar, shown here as 157, is releasably secured and hingedly secured to the shell 29 via pin means at 156. Spring means 159 attached to the shell 29 provide tension means to hold the top stop mount bar against rigid bracket 160 attached to the shell 29. Thus, a mechanical stress release is provided in this mode, where the post mount bar is allowed to move for any sudden small movements when working with the device. Instead of bending, it swings out, and springs back. Post guide with top stop is shown that is adjustable. Bar 130 slides within rings 131*a* and 131*b* and is secured and adjustable via eyebolts 153*a* and 153*b* used as set screws. Top stop 150 is hingedly attached to top stop bar 130 via bump spring means 152, so as to allow slight movement (shown as arrows 161) when bumping or the top against the offset beam 31.

Figure 10:
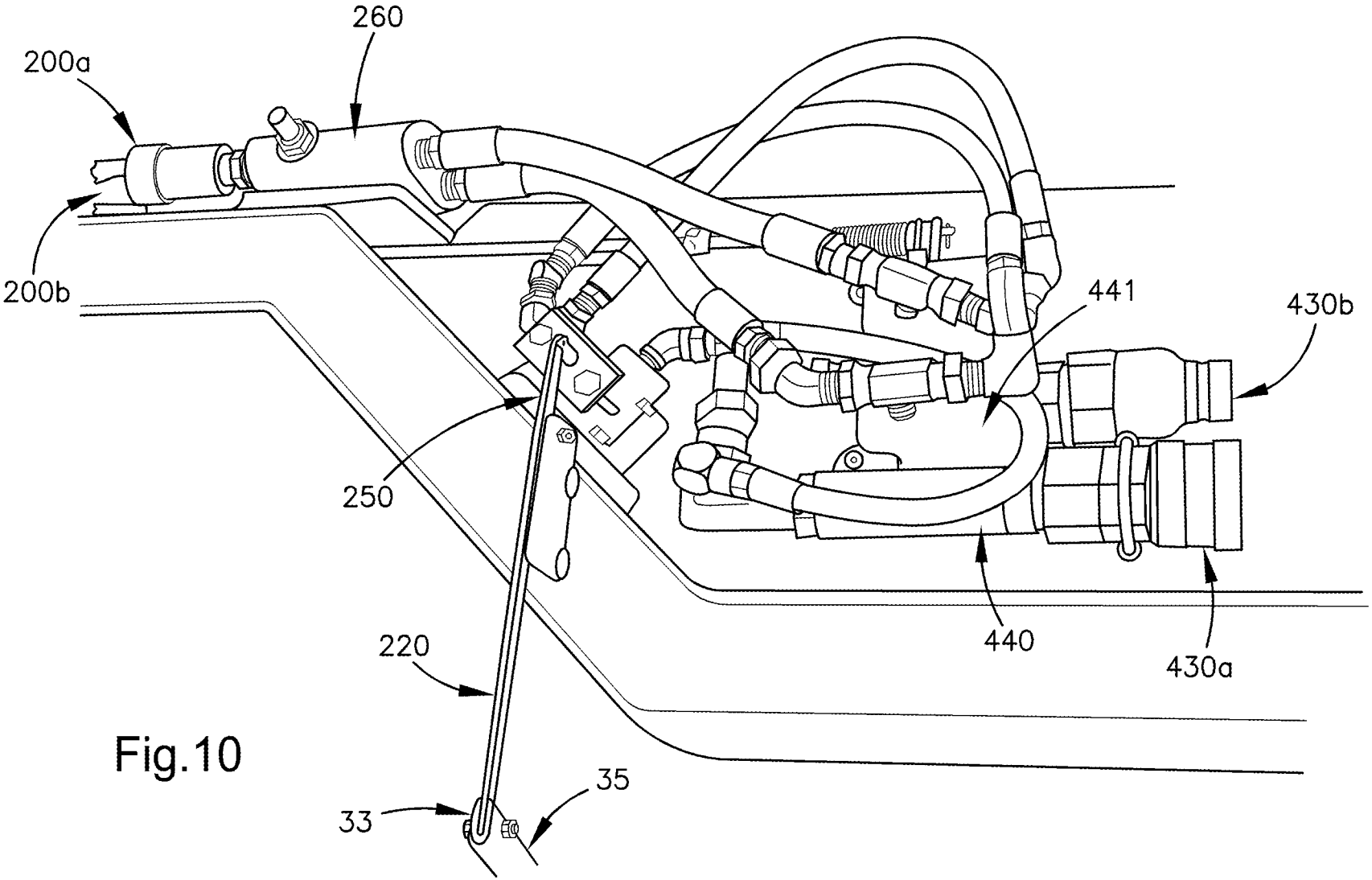
FIG. 10 is a close-up view of the hydraulics

FIG. 10 is shows the hydraulic arrangement that sits, in the preferred mode, high up hidden in the offset beam 31. Hydraulic lines 430*a* and 430*b* from the loader feed the invention hydraulics as shown. A key in the smooth operation is the use of a float valve 250 operated by lever 220 connected as shown. For example, the release valve 260 may activate at around 1500 psi, thus downward pressure is maintained at 1500 until the float valve is activated manually to release most pressure. The float valve 250, when released by pulling the release line 35 in FIG. 1, equalizes the pressure between the two cylinder hydraulic lines and the return lines, thus releasing nearly all pressure that might have even been sufficient to raise the loader offset beam a few inches. With that pressure released however via the float valve activated by the lever 220, the operator can now safely disengage the post securing assembly (operating arm 30) to disengage the device from the post. The operator can now raise the assembly, ready to move forward to place the next post. Without such a pressure releasing mechanism, sudden disengaging with pressure still at 1500 psi can cause significant significant frictionware on the drive lug 56 in FIG. 6*b*. Float valve 250 is a typical valve used for other purposes such as ground tracking movement of loaders. One such float valve is Prince brand model SS3B1D.

Drive stick 58 (FIG. 1) operates the wood splitter valve 441 to provide lock in détente so that one push up locks in the flow and thus movement of the cylinder until the cylinder reaches the end and the valve internal pressure trips and releases to stop the movement. Wood splitter valves are common and have internal mechanisms for sensing pressure. Check valve 440 operates as backflow preventer for the proper direction of flow (so that only outflow occurs at 430*a*, a female connection, and inflow at 430*b*, a male connection).

Figure 13:
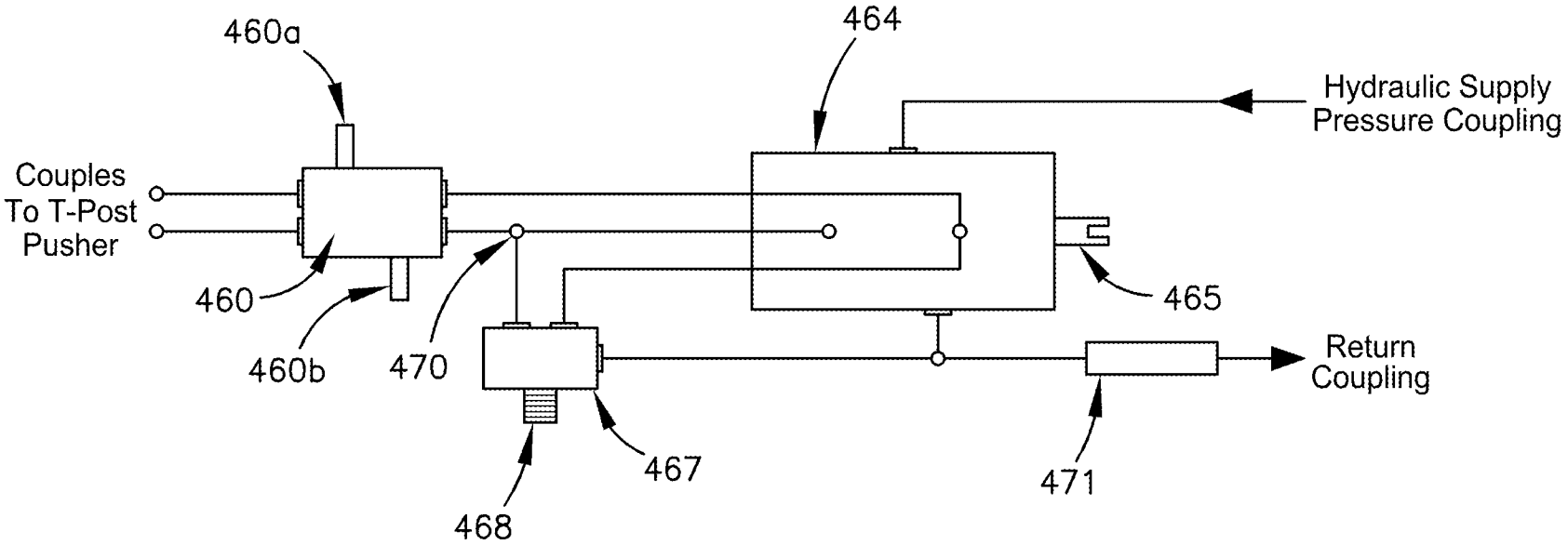
FIG. 13 is a schematic of the hydraulics in the described mode

The schematic for the hydraulics is show in FIG. 13. Double bypass 460, wood splitter valve 464, float valve 467 and check valve 471 are interconnected in the preferred mode as shown. Wood splitter has valve control 465. A spring holds the float valve control lever 468 in a normally closed position for all ports. All ports to the valve 467 are open when the lever is in the open position, i.e. when activated. This purges hydraulic pressure before opening the drive gate, as discussed. Adjustments 460*a* and 460*b* are pressure limiting adjustments to adjust the maximum pressure for each line.

Figure 11A:
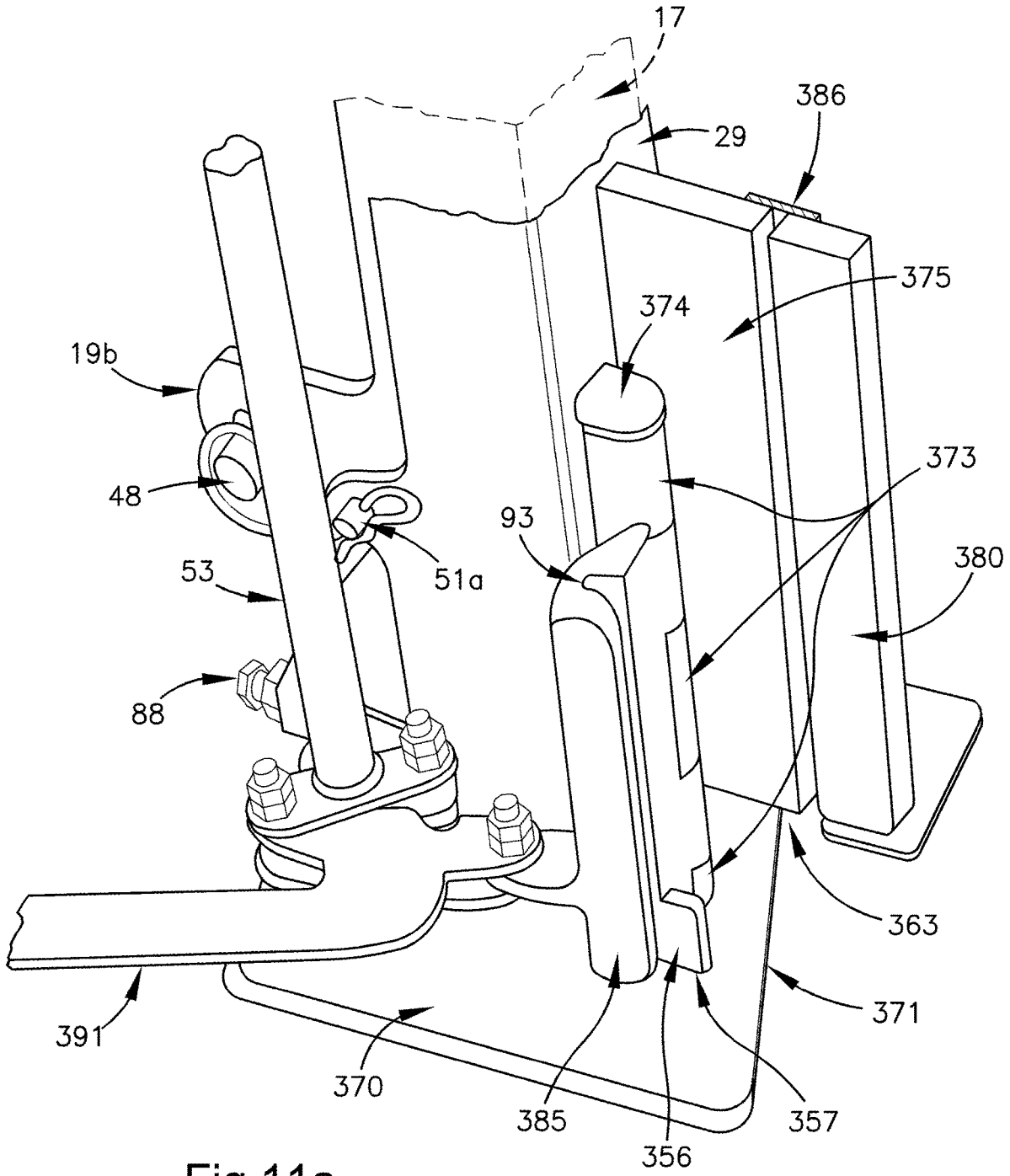
FIG. 11*a* is a close view of the reverse shell in use

A reverse shell assembly is shown in FIG. 11*a*. This is a separate attachable shell that allows for placing posts from an opposite direction. This requires slightly different structure, as shown, for the shell assembly. Thus in such a situation, one removes one shell assembly attached to the drive sleeve, and quickly attaches the other. Because the fence post teeth are being approached from a different direction, the parts are as shown. The parts are numbered as they were with the shell assembly in FIG. 6*a*, with a '3' added. Thus 363 corresponds to 63. An extension 380 is added to attach to guide bar 386 (shown here attached via plate 386 for perspective, inasmuch as the 386 and 380 could be one piece). Extension 357 is shown on the other side of the notch 93 as the post is rotated 180 degrees. Contours 363 are slightly different as well to match the T-post facing a reverse direction.

Figure 11B:
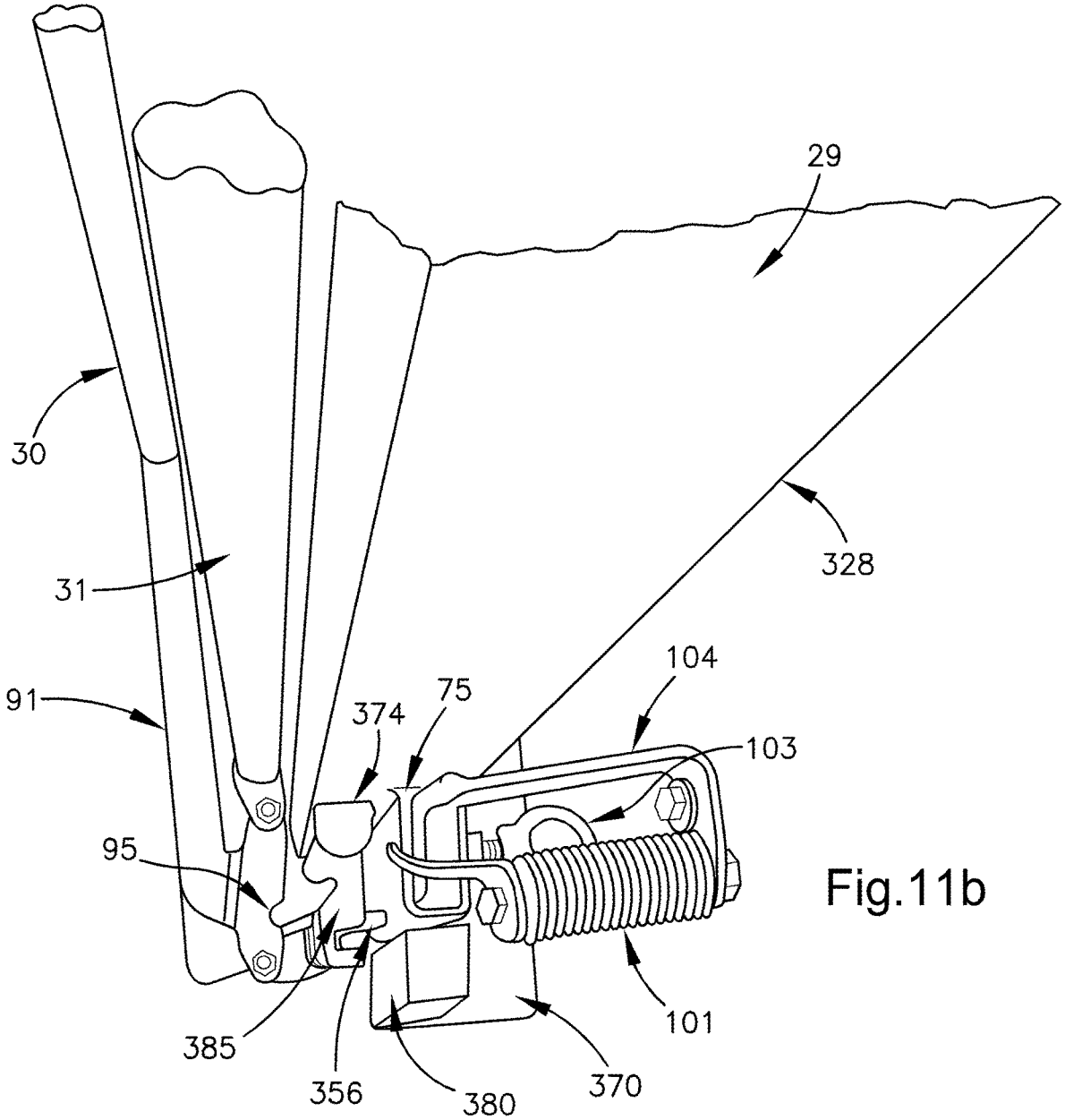
FIG. 11*b* is a close up view of the reverse shell with latch assembly in use, from above

Similarly, FIG. 11*b* is slightly altered as shown, with the parts numbered by adding a '3' to the corresponding parts in FIG. 7.

Figure 12:
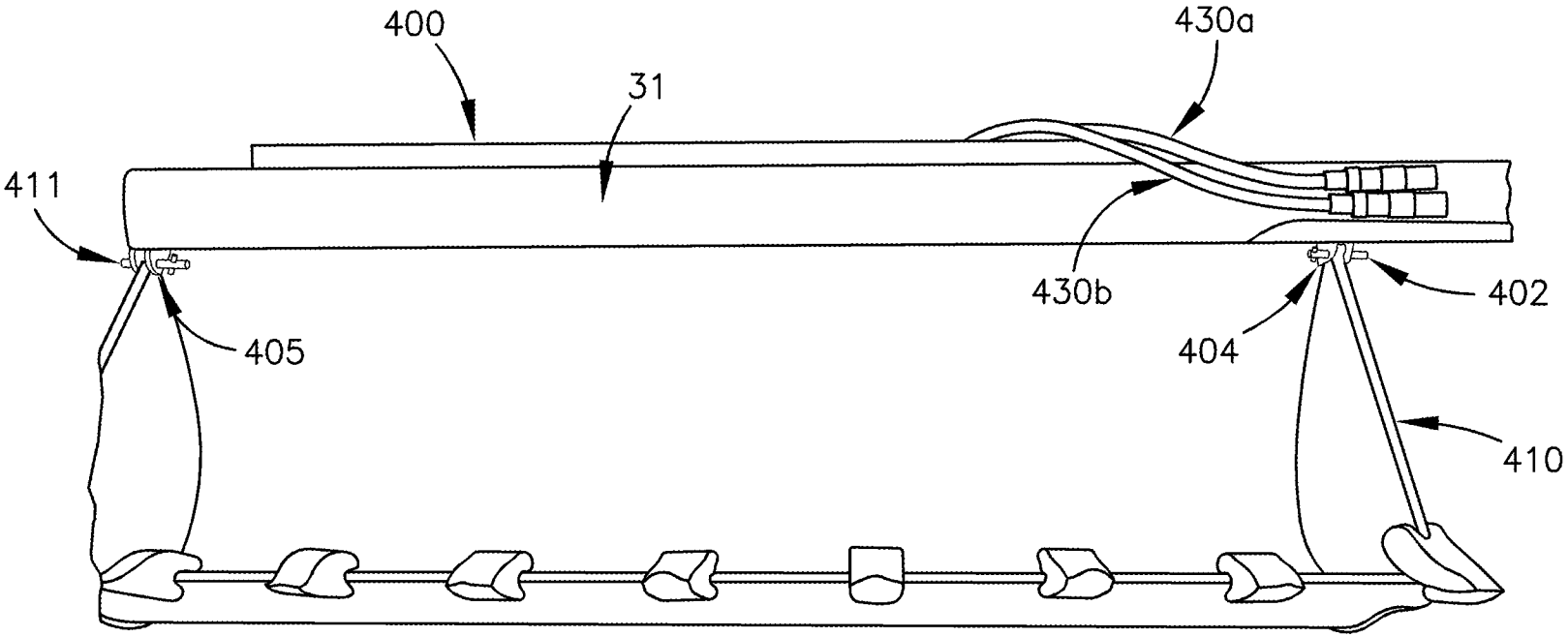
FIG. 12 is a front view of the loader with bucket showing how the invention is attached to the bucket

FIG. 12 shows how the invention is attached to the loader bucket. Offset beam 31 has mounting lugs 404 and 405 corresponding to typically available holes at that location on the bucket 410. Installation is simple, by simply attaching pins 401 and 402 through the holes on the bucket and the mounting lug holes. Hose protector 400 is an elongated metal or other protective material extending along the top to protect the hydraulic hoses. Hydraulic lines 430*a* and 430*b* attach to the loader hydraulics and feed the invention hydraulics in FIG. 10. They sit in the offset beam 31, protected by it. A post holding bucket attached to the tractor allows for holding a supply of posts.

In use, the operator lines up the tractor adjacent to, and essentially parallel to, the intended fence line where posts are to be placed. At the first location, a post is inserted against the post mount bar, raised to the top stop that has been preset to a setting so as to obtain uniform depth of post driving) then align with the guide shoe in the post holding assembly so as to set it between post teeth, and secured in place in reference to the guide foot 40, to provide for the intended depth. It is latched in place with the handle. When secure, the operator also checks the rotational position and adjusts it if necessary. When ready, the operator operates the hydraulic controls via drive stick 58 to continuously drive the post vertically until the guide foot touches the ground. The hydraulic downward pressure is released via activating stick 35 that operates float valve release 250. The latch is released, releasing the post that is now in the ground vertical and at the desired level, raises the ram 45 (and along with it the shell assembly 28) and the operator drives forward to the next position in accordance with GPS or other measurement means on the tractor, and repeats the process.

It will be seen that the self-locking means (upper and/or lower), if built sufficiently sturdy, can secure posts without the guide shoe 96 and post guide mount bracket assembly, and thus an alternative mode excludes these elements. Thus, posts similar to T-posts but without teeth or nubs, can be driven using such a mode of the invention.

Thus, what is shown is a nonimpact driving attachment for driving T-posts and other fence posts into the ground in a truer vertical, uniform and consistent manner, accurately, and without risking damage to the posts. Other features and objects are apparent in this specification and to those skilled in the art.

I claim:

1. An apparatus for releasably securing a removeable rigid member to a rigid holding bar, said apparatus comprised of a series of at least two rigid links pivotally interconnected such that pivotal movement of one link causes pivotal movement of at least one other link, where the series has a first end connected to the holding bar and an opposing end connected to a rigid latch hingedly connected to the holding bar so as to secure the removeable rigid member to the holding bar, handle means so as to provide pivotal movement of at least one link, said apparatus having rigid stop means adjacent to at least one link for restricting pivotal movement of that link beyond a desired point so as to create a stop position.

2. An apparatus for releasably securing a removeable rigid member to a rigid holding bar, said apparatus comprised of a series of at least two rigid links pivotally interconnected such that pivotal movement of one link causes pivotal movement of at least one other link, where the series has a first end connected to the holding bar and an opposing end connected to a rigid latch hingedly connected to the holding bar so as to secure the removeable rigid member to the holding bar, handle means attached to at least one link for rotationally moving said link such that rotational movement of said link creates at least two alternative positions of the rigid latch, a first open position to allow placement of the removeable rigid member against the holding bar, and a second locked closed position where in the closed position the rigid latch secures the removeable rigid member against the holding bar.

3. An apparatus for releasably securing a removeable rigid member to a rigid holding bar, said apparatus comprised of a first series of at least two rigid links pivotally interconnected such that pivotal movement of one link causes pivotal movement of at least one other link, and a second series of rigid links pivotally interconnected to each other, and said apparatus having an elongated rigid handle between and operationally connecting the two series, and where the said handle has a first end and a second end where the first end is connected to at least one link of the first series, and the second end is connected to at least one link in the second series, and wherein each series of links has a first end and a second end with the links in between the first end and second end pivotally interconnected to each other, wherein the first end of the first series is attached to a rigid latch member hingedly connected to the holding bar, and the second end of the first series is attached to the holding bar, and wherein the first end of the second series is attached to a rigid latch member hingedly attached to the holding bar, and said apparatus further having stop means for restricting pivotal movement of at least one link in one of the series so as to create a stop position.

4. The apparatus in claim 3 wherein the stop means is adjustable so as to allow different desired stop positions.

5. An apparatus for releasably securing a removable rigid member to a rigid holding bar, said apparatus comprised of a rigid latch member hingedly attached to the rigid holding bar, a first rigid link having a first end and a second end wherein said first end is attached to the rigid latch member, a second rigid link having a first end and a second end wherein said first end is pivotally attached to the second end of the first rigid link member, a third rigid link having a first end and a second end wherein the first end is pivotally attached to the second end of the second link member, a fourth rigid link having a first end, a stop side end opposite said first end, and a second end, wherein said first end of the fourth rigid link is pivotally attached to the second end of the third rigid link member, a fifth rigid link having a first end and a second end, wherein said first end is pivotally attached to the second end of the fourth rigid link, and wherein the first end of the fifth rigid link is attached to the bar, rigid stop means adjacent the stop side of the fourth rigid member for restricting movement of said stop side, rigid handle means extending from at least one of the second or third links such that movement of the rigid handle means moves the rigid latch member to secure the removeable rigid member against the bar.

6. The apparatus in claim 5 wherein the stop means is adjustable so as to allow the stop side of the fourth rigid link to have different desired stop positions.

7. An apparatus for releasably securing a post to a rigid holding bar at spaced apart locations on the post, said apparatus comprised of an upper link assembly and a lower link assembly, a rigid handle connecting said assemblies so as to cause them to operate in conjunction to secure the post, wherein the upper link assembly is comprised of a rigid latch member hingedly attached to the rigid holding bar, a first rigid link having a first end and a second end wherein said first end is attached to the rigid latch member, a second rigid link having a first end and a second end wherein said first end is pivotally attached engagedly connected to the second end of the first rigid link member, a third rigid link having a first end and a second end wherein the first end is pivotally attached to the second end of the second link member, a fourth rigid link having a first end and a second end wherein said first end has an elongated hole for pivotally attaching to the second end of the third rigid link member, and wherein the second end of the fourth rigid link is attached to the rigid holding bar, and wherein the lower link assembly is comprised of a rigid latch member hingedly attached to the rigid holding bar, a first rigid link having a first end and a second end wherein said first end is attached to the rigid latch member, a second rigid link having a first end and a second end wherein said first end is pivotally attached to the second end of the first rigid link member, a third rigid link having a first end and a second end wherein the first end is pivotally attached to the second end of the second link member, a fourth rigid link having a first end, a stop side end opposite said first end, and a second end, wherein said first end of the fourth rigid link is pivotally attached to the second end of the third rigid link member, a fifth rigid link having a first end and a second end, wherein said first end is pivotally attached to the second end of the fourth rigid link, and wherein the first end of the fifth rigid link is attached to the bar, rigid stop means adjacent the stop side of the fourth rigid member for restricting movement of said stop side, and where the rigid handle has a first end and a second end, wherein the first end extends from at least one of the second or third links on the lower link assembly to at least one of the second or third links in the upper link assembly, such that movement of the rigid handle moves the rigid latch member of the respective assemblies to secure the post against the bar.

8. The apparatus in claim 7 wherein the stop means is adjustable so as to allow the stop side of the fourth rigid link of the lower link assembly to have different stop positions as desired.

* * * * *